US011807006B2

(12) United States Patent
Horrocks

(10) Patent No.: US 11,807,006 B2
(45) Date of Patent: Nov. 7, 2023

(54) INKJET PRINTHEAD ASSEMBLY WITH WIREBOND PROTECTION

(71) Applicant: MEMJET TECHNOLOGY LIMITED, Dublin (IE)

(72) Inventor: Glenn Horrocks, North Ryde (AU)

(73) Assignee: Memjet Technology Limited, Dublin (IE)

( * ) Notice: Subject to any disclaimer, the term of this patent is extended or adjusted under 35 U.S.C. 154(b) by 36 days.

(21) Appl. No.: 17/565,267

(22) Filed: Dec. 29, 2021

(65) Prior Publication Data

US 2022/0203686 A1 Jun. 30, 2022

Related U.S. Application Data

(60) Provisional application No. 63/131,719, filed on Dec. 29, 2020.

(51) Int. Cl.

| | |
|---|---|
| ***B41J 2/15*** | (2006.01) |
| ***B41J 2/14*** | (2006.01) |
| ***B41J 2/155*** | (2006.01) |
| ***B41J 29/38*** | (2006.01) |

(52) U.S. Cl.

CPC ..... *B41J 2/155* (2013.01); *B41J 2/14* (2013.01); *B41J 29/38* (2013.01); *B41J 2002/14419* (2013.01); *B41J 2002/14491* (2013.01); *B41J 2202/20* (2013.01)

(58) Field of Classification Search

CPC ..... B41J 2/155; B41J 2/14; B41J 29/38; B41J 2002/14419; B41J 2002/14491

See application file for complete search history.

(56) References Cited

U.S. PATENT DOCUMENTS

| | | | | |
|---|---|---|---|---|
| 5,177,500 | A * | 1/1993 | Ng | B41J 2/45 361/826 |
| 6,439,680 | B1 * | 8/2002 | Mochizuki | B41J 2/04598 347/11 |
| 2010/0220147 | A1 * | 9/2010 | Silverbrook | B41J 2/16505 347/44 |
| 2018/0222199 | A1 * | 8/2018 | Thelander | B41J 2/1433 |

* cited by examiner

*Primary Examiner* — Jason S Uhlenhake
(74) *Attorney, Agent, or Firm* — Cooley LLP

(57) ABSTRACT

A printhead assembly includes: an ink manifold comprised of a first metal; printhead chips mounted on the ink manifold and receiving ink therefrom, each printhead chip having a plurality of bond pads; a PCB mounted on the ink manifold, the PCB having a plurality of contact pads; a plurality of wirebonds interconnecting the bond pads and the contact pads, the wirebonds being comprised of a second metal; an encapsulant material encapsulating the wirebonds, the bond pads and the contact pads; and a voltage source. The ink manifold and the wirebonds are electrically connectable to the voltage source to provide cathodic protection of the wirebonds.

10 Claims, 4 Drawing Sheets

INKJET PRINTHEAD ASSEMBLY WITH WIREBOND PROTECTION

CROSS REFERENCE TO RELATED APPLICATIONS

This application claims priority to and the benefit of U.S. Provisional Patent Application No. 63/131,719, entitled INKJET PRINTHEAD ASSEMBLY WITH WIREBOND PROTECTION, filed on Dec. 29, 2020, the disclosure of which is incorporated herein by reference in its entirety for all purposes.

FIELD OF THE INVENTION

This invention relates to inkjet printheads having wirebond connections to printhead chips. It has been developed primarily to protect wirebonds from corrosion.

BACKGROUND OF THE INVENTION

The Applicant has previously described methods for encapsulation of wirebonds in inkjet printheads (see, for example, U.S. Pat. No. 8,063,318, the contents of which are incorporated herein by reference). Wirebonds carry data and power to printhead chips and are critical components in an inkjet printhead. If any wirebonds fracture due to thermo-mechanical stress or corrosion, the printhead becomes unusable and must be replaced.

U.S. application Ser. No. 17/399,818 filed Aug. 11, 2021 describes wirebond encapsulation using two different types of encapsulant: a softer polymer core allowing a degree of mechanical flex and a harder polymer shell providing more robust protection against chemical attack.

U.S. Pat. No. 10,442,200, the contents of which are incorporated herein by reference, describes a printhead having a plurality of printhead dies attached to a metal alloy manifold via a metal alloy shim Such printheads have been designed for use with pigment-based inks and, further, enable construction of relatively long printheads, such as A3 pagewide printheads.

The Applicant's studies have found that printheads having an ink manifold formed of metal alloys, such as Invar, exhibit surprising susceptibility to wirebond and/or bond pad failures when compared to printheads having ink manifolds formed of a liquid crystal polymer.

It would therefore be desirable to provide a means for improving the robustness of wirebonds in printheads, particularly printheads having an ink manifold formed of a metal.

SUMMARY OF THE INVENTION

In a first aspect, there is provided a printhead assembly comprising:

an ink manifold comprised of a first electrically conductive material;

one or more printhead chips mounted on the ink manifold and receiving ink therefrom, each printhead chip having a plurality of bond pads;

a PCB mounted on the ink manifold, the PCB having a plurality of contact pads;

a plurality of wirebonds interconnecting the bond pads and the contact pads, wherein the wirebonds and/or bond pads are comprised of a second electrically conductive material different than the first electrically conductive material;

an encapsulant material encapsulating the wirebonds, the bond pads and the contact pads; and a voltage source, wherein the ink manifold and the wirebonds are electrically connectable to the voltage source.

The printhead assembly of the first aspect advantageously provides cathodic protection of the wirebonds from galvanic corrosion, as will be explained in more detail below.

Preferably, the ink manifold is electrically connectable to a positive terminal of the voltage source and one or more of said wirebonds are electrically connectable to a negative terminal of the voltage source. Typically, the potential at the wirebonds is in the range of −0.1 to −1.5 volts or −0.5 to −1.2 volts.

Preferably, the first and second electrically conductive materials are first and second metals.

Preferably, the second metal has a lower (i.e. more negative) electrode potential than the first metal.

Preferably, the wirebonds are comprised of aluminum.

Preferably, the ink manifold is comprised of an iron alloy.

Preferably, the printhead assembly further comprises a switch, wherein the switch is configured to electrically connect the ink manifold and the wirebonds to the voltage source only when the printhead chips are not receiving power and/or data via the wirebonds.

Preferably, the printhead chips are mounted on the ink manifold via an intervening shim, typically in the form of a sheet or film having ink supply holes defined therein.

Preferably, the shim comprises a metal alloy.

Preferably, the voltage source is a battery or cell, which may be user-replaceable.

As used herein, the term "PCB" is taken to mean a printed circuit board of the type having a non-conductive substrate and one or more conductive tracks carrying electrical signals. The non-conductive substrate may be flexible or rigid. The PCB may comprise additional electronic components (e.g. capacitors, resistors etc.) or, alternatively, the PCB may be absent any additional electronic components and serve only to carry electrical signals via its conductive tracks.

As used herein, the term "ink" is taken to mean any printing fluid, which may be printed from an inkjet printhead. The ink may or may not contain a colorant. Accordingly, the term "ink" may include conventional dye-based or pigment-based inks, infrared inks, fixatives (e.g. pre-coats and finishers), 3D printing fluids (e.g. binder fluids), biological fluids, functional fluids (e.g. sensor inks, solar inks etc.) and the like. Where reference is made to fluids or printing fluids, this is not intended to limit the meaning of "ink" herein.

As used herein, the term "mounted" includes both direct mounting and indirect mounting via an intervening part.

As used herein, the term "metal" is taken to include pure metals, metal alloys, metal composites and metalloids. Where reference is made herein to, for example, metal alloys (e.g. iron alloys), this is not intended to limit the meaning of the term "metal".

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
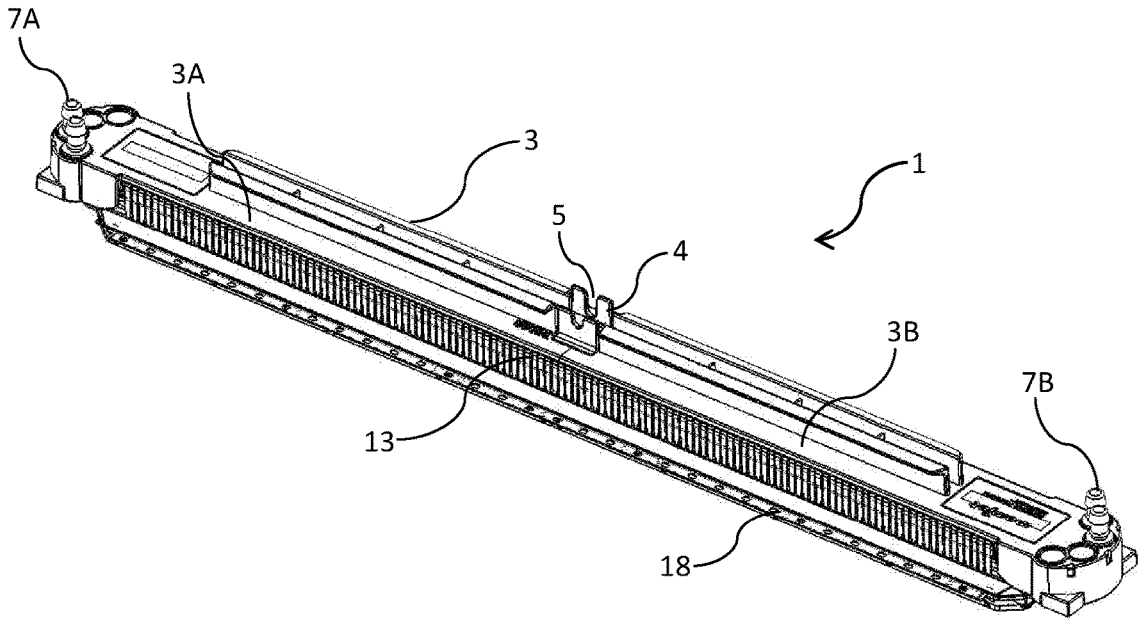
FIG. 1 is a front perspective view of an inkjet printhead.
Figure 2:
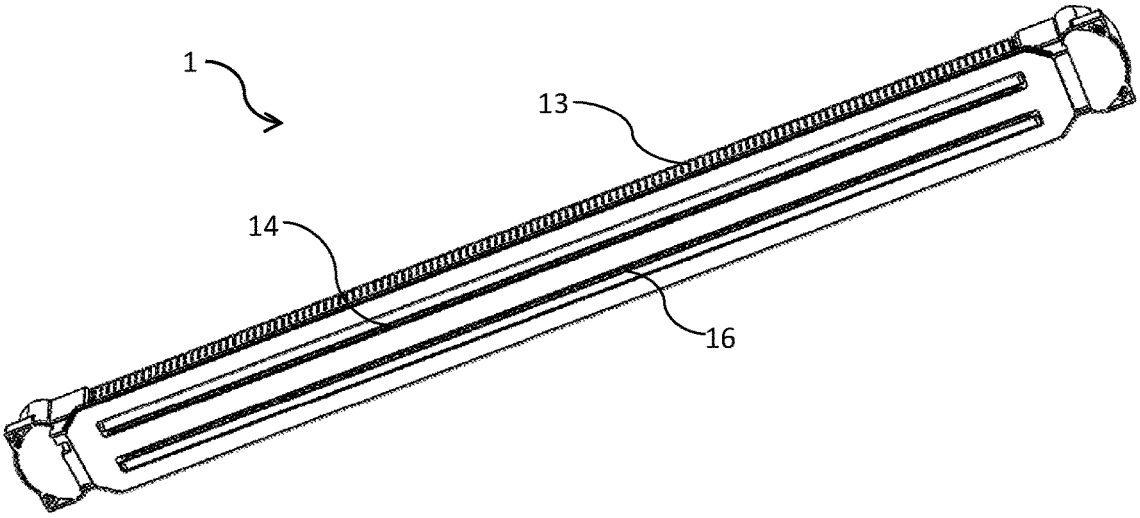
FIG. 2 is a bottom perspective of the printhead.
Figure 3:
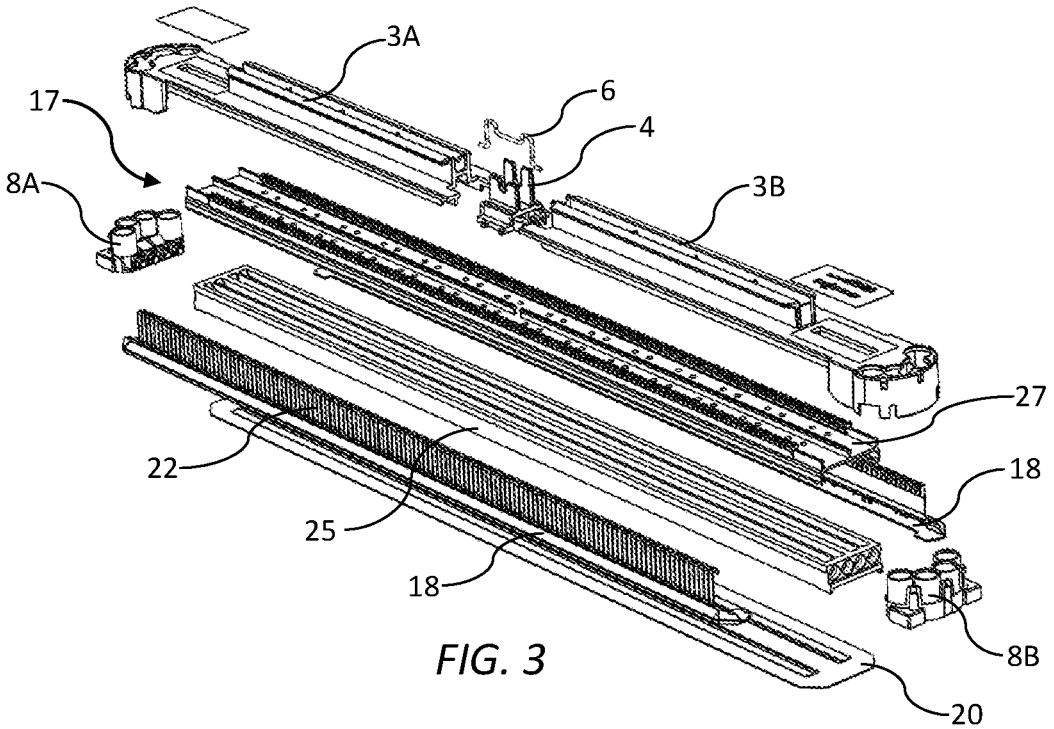
FIG. 3 is an exploded perspective of the printhead.

Referring to FIGS. 1 to 3, there is shown an inkjet printhead 1, as described in U.S. Pat. No. 10,442,200, the contents of which are incorporated herein by reference. The printhead 1 comprises an elongate molded plastics casing 3 with ink connectors at each end thereof. Inlet connectors 7A of a multi-channel inlet coupling 8A protrude upwards through openings at one end of the casing 3; and outlet connectors 7B of a multichannel outlet coupling 8B protrude upwards through an opening at an opposite end of the casing (only two inlet connectors and two outlet connectors shown in FIG. 1). The inlet and outlet connectors 7A and 7B are configured for coupling with complementary fluid couplings (not shown) supplying ink to and from the printhead.

The casing 3 has a first part 3A and a second part 3B positioned at either side of a central locator 4, the first and second casing parts 3A and 3B being biased towards each other and the central locator 4 by means of a spring clip 6 engaged therebetween. The two-part casing 3 in combination with the spring clip 6 enables the casing to expand longitudinally, at least to some extent, to accommodate a degree of longitudinal expansion in a main body 17 of the printhead 1.

The printhead 1 receives power and data signals via opposite rows of electrical contacts 13, which extend along respective sidewalls of the printhead. The electrical contacts 13 are configured to receive power and data signals from complementary contacts of a printer (not shown) or print module and deliver the power and data to printhead chips 70 via respective PCBs 18, as will be explained in more detail below.

As shown in FIG. 2, the printhead 1 comprises a first row 14 and a second row 16 of printhead chips 70 for printing onto print media (not shown) passing beneath the printhead. Each row of printhead chips is configured for printing two colors of ink, such that the printhead 1 is a full color pagewide printhead capable of printing four ink colors (CMYK) redundantly. The printhead 1 is generally symmetrical about a longitudinal plane bisecting the first row 14 and the second row 16 of printhead chips, notwithstanding the different ink colors in the printhead during use.

In the exploded perspective shown in FIG. 3, it can be seen that a main body 17 forms a rigid core of the printhead 1 for mounting various other components. In particular, the casing 3 is snap-fitted to an upper part of the main body 17; the inlet and outlet couplings 8A and 8B (enshrouded by the casing 3) are connected to opposite ends of the main body; a pair of PCBs 18 are attached to a lower part of the main body (which are in turn covered by a shield plate 20); and a plurality of leads 22 (which define the electrical contacts 13) are mounted to opposite sidewalls of the main body.

The main body 17 is a two-part machined structure comprising an elongate ink manifold 25 and a complementary cover plate 27. The ink manifold 25 functions as a carrier substrate having a unitary lower surface for mounting the first and second rows 14 and 16 of printhead chips 70 as well as respective PCBs 18. The manifold 25 and cover plate 27 are formed of a metal alloy material (e.g. Invar) having relatively high stiffness and a relatively low coefficient of thermal expansion. In combination, the manifold 25 and cover plate 27 provide a stiff, rigid structure at the core of the printhead 1 with minimal expansion along its longitudinal axis. As foreshadowed above, the casing 3 is configured so as not to constrain any longitudinal expansion of the main body 17 and thereby minimizes bowing of the printhead during use. Accordingly, the printhead 1 may be provided as an A4-length printhead or an A3-length printhead.

Figure 4:
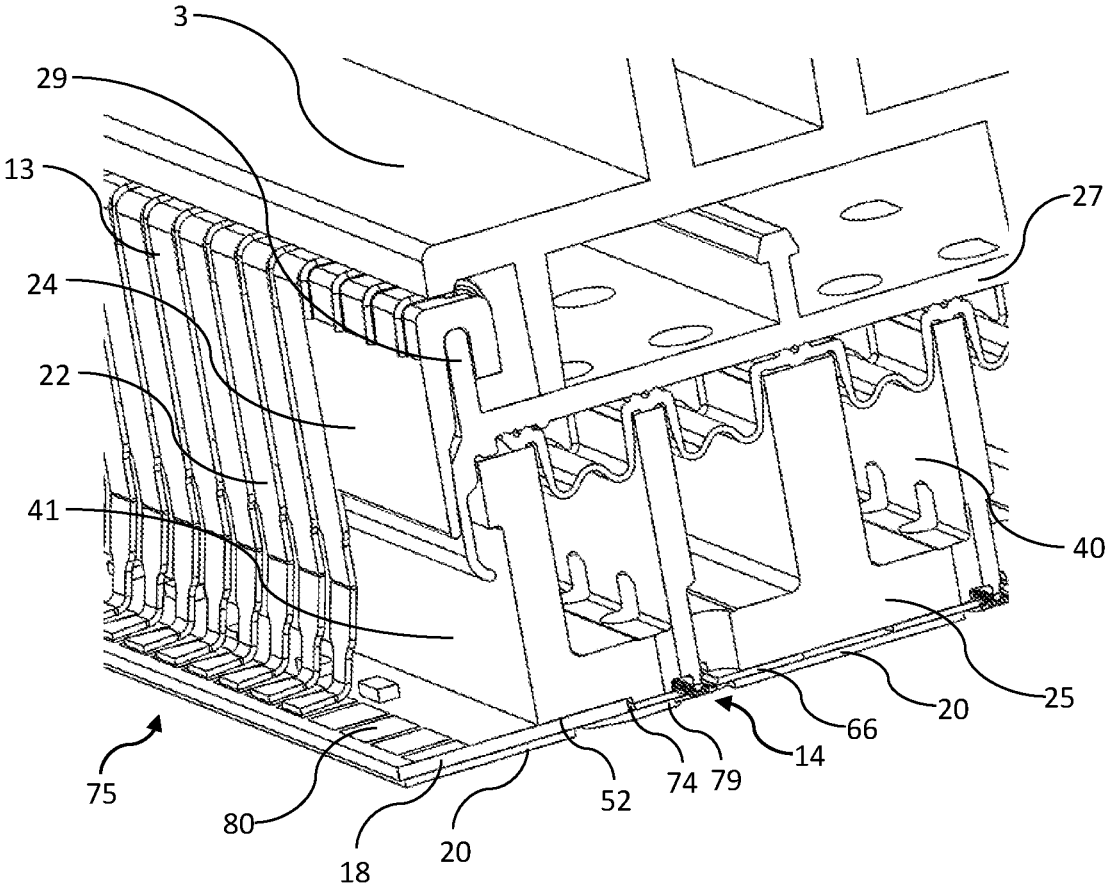
FIG. 4 is a magnified cross-sectional perspective of the part of the printhead.

Referring to FIG. 4, an Invar shim 66 is adhesively bonded to a lower surface 52 of the manifold 25 and a plurality of printhead chips 70, arranged in the first and second rows 14 and 16, are adhesively bonded to the shim 66 (only the first row 14 of printhead chips visible in FIG. 4). Each row of printhead chips 70 receives ink from longitudinal ink supply channels 40 defined in the manifold 25 via through-holes in the shim 66.

A pair of longitudinal PCBs 18 flank the first row 14 and second row 16 of printhead chips 70 at opposite sides thereof, each PCB being bonded to the lower surface 52 of the manifold 25. Each PCB 18 comprises a rigid substrate (e.g. FR-4 substrate) for mounting of various electronics components and has one edge butting against a step 74 defined in the lower surface 52 of the manifold 25. Each PCB 18 extends laterally outwards beyond sidewalls 41 of the manifold 25. A shield plate 20 is bonded to a lower surface of each PCB 18 and surrounds the first and second rows 14 and 16 of printhead chips 70 as well as a central longitudinal region between the first and second rows. The protruding portions of each PCB 18 and the shield plate 20 define opposite wings 75 of the printhead 1, while a uniformly planar lower surface of the shield plate 20 is configured for engagement with a perimeter capper (not shown) surrounding both rows of printhead chips.

Figure 5:
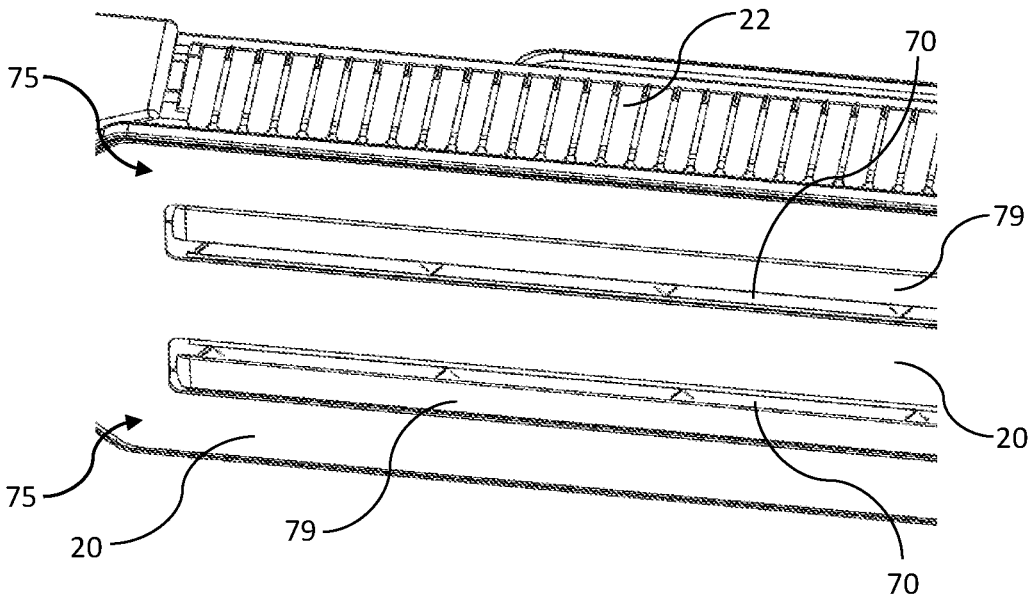
FIG. 5 is a bottom perspective of part of the printhead.
Figure 6:
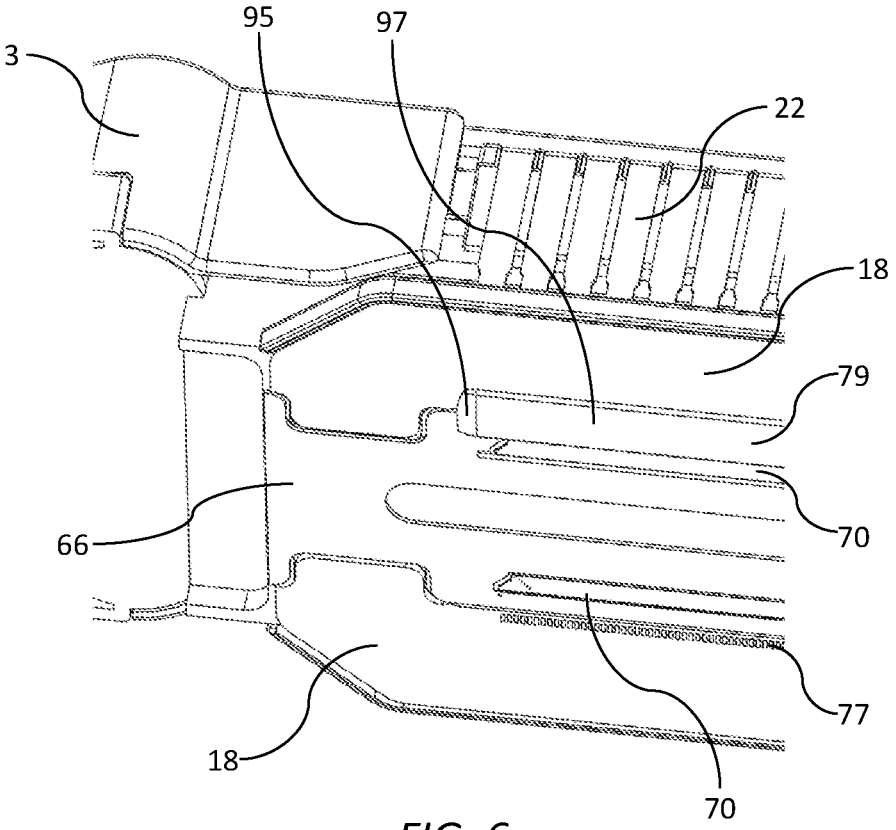
FIG. 6 is a magnified bottom perspective of the printhead with a shield plate and encapsulant removed for one row of printhead chips.

Still referring to FIG. 4, a row of connection pads 80 extends longitudinally along a distal edge portion of an upper surface of each PCB 18. Each lead 22 has one end connected to a connection pad 80 and extends upwardly towards a respective sidewall of the main body 17. The leads 22 have an upper portion mounted to a respective flange 29 of the cover plate 27 via a lead retainer 24 affixed thereto, and a lower portion which flares laterally outwards towards the connection pads 80. Each lead 22 also has a portion defining the electrical contact 13 for connection to external power and data connectors of a printer Referring now to FIGS. 5 and 6, an edge of each PCB 18 proximal a respective row of printhead chips 70 has a respective row of pinouts in the form of contact pads 77. Each contact pad 77 is connected to a respective bond pad 73 on one of the printhead chips via a wirebond connection (not visible in FIGS. 5 and 6). In this way, each row of printhead chips 70 receives power and data from the electricals contacts 13 via the leads 22 and a respective PCB 18 adjacent the row of printhead chips.

The wirebonds are protected by an encapsulant package 79, which extends between the proximal edge of each PCB 18 containing the contact pads 77 and a proximal edge of the printhead chips 70 containing the bond pads 73. The encapsulant package 79 is formulated to provide robust protection of the wirebonds, particularly with respect to chemical attack from high pH inks, which typically contain aggressive cosolvents and surfactants.

Figure 7:
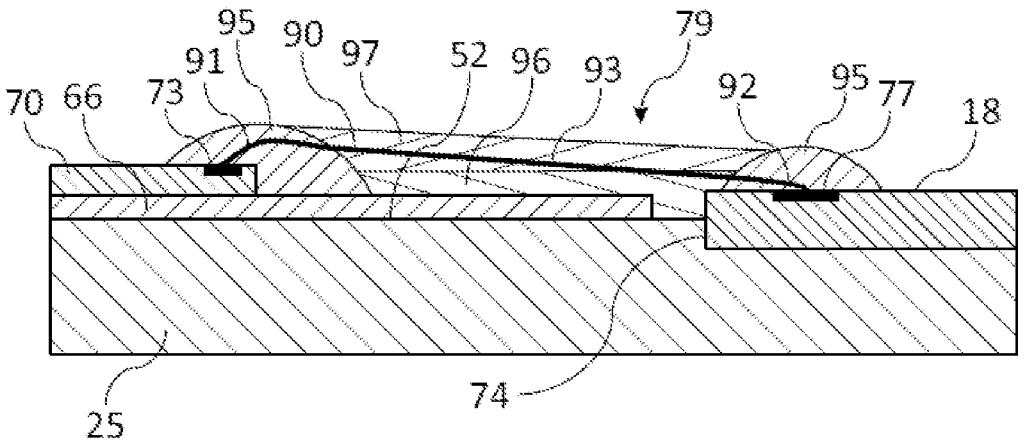
FIG. 7 is a schematic side sectional view of a connection region between a printhead chip and a PCB.

FIG. 7 shows schematically a side sectional view of a connection region of the PCB 18 and one printhead chip 70, as described in U.S. Provisional Application No. 63/065,439 filed Aug. 13, 2020, the contents of which are incorporated herein by reference. The printhead chip 70, having a longitudinal row of bond pads 73, is mounted on a lower surface 52 of the ink manifold 25 via the intervening shim 66. The PCB 18 having contact pads 77 is directly mounted on the lower surface 52 of the ink manifold 25 adjacent the printhead chip 70 and received in the stepped portion 74 of the lower surface. A wirebond 90 interconnects the bond pad 73 and the contact pad 77. The wirebond 90 has a first end portion 91 bonded to the bond pad 73, an opposite second end portion 92 bonded to the contact pad 77 and an intermediate section 93 extending between the first and second end portions.

The encapsulant package 79, which is designed to protect the wirebond 90, as well as the bonds pads 73 and contact pads 77, comprises three components: (1) a bead of dam encapsulant 95 extending longitudinally along the row of bond pads 73 and the row of contact pads 77, and forming an endless perimeter dam via transverse interconnecting portions at each longitudinal end thereof; (2) a first fill encapsulant 96 having a relatively low modulus of elasticity disposed within the perimeter of dam encapsulant 95 on the lower surface the ink manifold 25 and an exposed portion of the shim 66; and (3) a second fill encapsulant 97 having a relatively higher modulus of elasticity disposed on the first fill encapsulant 96 within the perimeter of dam encapsulant. The dam encapsulant 95 encapsulates the first and second end portions 91 and 92 of the wirebond 90 as well as the bond pads 73 and contact pads 77, while the first and second fill encapsulants 96 and 97 together encapsulate the intermediate section 93 of the wirebond.

Although the encapsulant package 97 is designed to provide robust resistance to ink, it has been found by the present Applicant through rigorous testing, that wirebonds 90 were subject to corrosion when the printhead 1 was soaked in ink for extended periods. Furthermore, it was found that a small amount of ink was absorbed by the encapsulant material (e.g. up to about 5% uptake by weight) during ink soak testing.

Without wishing to be bound by theory, it is understood by the present Applicant that this small degree of ink uptake in the encapsulant material provides an electrolytic pathway between the wirebonds 90, which are typically comprised of aluminum or an alloy thereof, and the ink manifold 25, which is comprised of an iron-nickel alloy (e.g. Invar) in the printhead 1. With the wirebonds 90 and the ink manifold 25 being formed from metals having differing electrode potentials, this electrolytic pathway is understood to provide a galvanic corrosion mechanism. Further evidence of an accelerated galvanic corrosion mechanism in the printhead 1 can be inferred by a comparison with printheads having an LCP ink manifold, such as those described in U.S. Pat. No. 9,950,527. In those printheads having an LCP manifold, wirebonds were relatively resistant to corrosion during similar ink soak tests, even when the encapsulant material had a similar degree of ink uptake.

Figure 8:
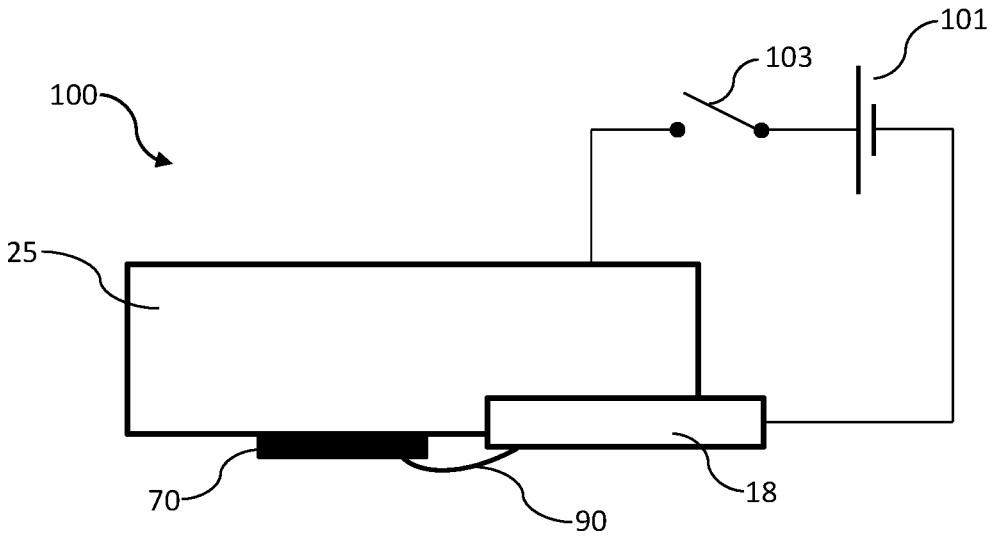
FIG. 8 is shows schematically a printhead assembly having impressed current cathodic protection of wirebonds.

Having identified the problem of accelerated galvanic corrosion in certain printheads via an unexpected electrolytic pathway through the encapsulant material, the Applicant sought to address this problem using cathodic protection of the wirebonds. Accordingly, and referring to FIG. 8, there is shown schematically a printhead assembly 100 having impressed current cathodic protection of wirebonds 90 using a voltage source in the form of an electrical cell 101 supplying direct current. A negative terminal of the cell 101 is electrically connected to the wirebonds 90 via the PCB 18, while a positive terminal of the cell is electrically connected to a surface of the ink manifold 25. By lowering the electrical potential of the wirebonds 90 relative to the ink manifold 25, the wirebonds 90 enjoy cathodic protection from corrosion in a worst-case scenario where ink contacts the encapsulant material (not shown in FIG. 8) for extended periods.

A switch 103 is provided for controlling the cathodic protection when required. For example, during normal printing when the wirebonds 90 carry power and/or data to the printhead chips 70, the switch is open so that current from the cell 101 does not interfere with sensitive electrical signaling from the PCB 18 to the printhead chips 70. However, for the majority of time (e.g. during printhead idle periods), the switch 103 is closed to provide impressed current cathodic protection of the wirebonds 90. The switch 103 is typically open and closed automatically by mechanisms well known to those skilled in the art. For example, the switch 103 may be a solenoid switch actuated via a printer controller (not shown).

Experimentally, it was found that impressed current cathodic protection provided excellent protection of wirebonds from corrosion during ink soak tests. With an Invar coupon held in proximity to aluminum wirebonds and separated via an ink electrolyte, a potential of about −0.8V at the aluminum wirebonds relative to the Invar coupon was found to be optimal for protection of the wirebonds from corrosion. A higher (more positive) potential did not fully protect the wirebonds, while a lower (more negative) potential caused dark deposits on the Invar coupon as well as significant wirebond corrosion (possibly due to reversing the polarity of galvanic corrosion or forcing a different corrosion mechanism). It will be appreciated by those skilled in the art that an optimized potential of the cell 101 may be determined empirically for a given printhead assembly 100.

Accordingly, the present invention provides a relatively simple means for protection of wirebonds susceptible to an unexpected galvanic corrosion mechanism. Furthermore, the use of impressed current cathodic protection, as opposed to alternative cathodic protection measures, ensures reduced corrosion in a controllable manner with minimal residues and with only a minor modification to existing printhead assemblies.

It will, of course, be appreciated that the present invention has been described by way of example only and that modifications of detail may be made within the scope of the invention, which is defined in the accompanying claims.

The invention claimed is:

1. A printhead assembly comprising:

an ink manifold comprised of a first electrically conductive material;

one or more printhead chips mounted on the ink manifold and receiving ink therefrom, each printhead chip having a plurality of bond pads;

a PCB mounted on the ink manifold, the PCB having a plurality of contact pads;

a plurality of wirebonds interconnecting the bond pads and the contact pads, wherein the wirebonds and/or bond pads are comprised of a second electrically conductive material different than the first electrically conductive material;

an encapsulant material encapsulating the wirebonds, the bond pads and the contact pads;

a voltage source; and a switch, wherein:

the ink manifold and the wirebonds are electrically connectable to the voltage source; and the switch is configured to electrically connect the ink manifold and the wirebonds to the voltage source only when the printhead chips are not receiving power and/or data via the wirebonds.

2. The printhead assembly of claim 1, wherein the ink manifold is electrically connectable to a positive terminal of the voltage source and one or more of said wirebonds are electrically connectable to a negative terminal of the voltage source.

3. The printhead assembly of claim 1, wherein the first electrically conductive material is a first metal and the second electrically conductive material is a second metal.

4. The printhead assembly of claim 3, wherein the second metal has a lower electrode potential than the first metal.

5. The printhead assembly of claim 1, wherein the wirebonds and/or bond pads are comprised of aluminum.

6. The printhead assembly of claim 1, wherein the ink manifold is comprised of an iron alloy.

7. The printhead assembly of claim 1, wherein the printhead chips are mounted on the ink manifold via an intervening shim.

8. The printhead assembly of claim 7, wherein the shim comprises a metal alloy.

9. The printhead assembly of claim 1, wherein the voltage source is a battery or cell.

10. The printhead assembly of claim 1, wherein the voltage is connectable to the wirebonds via the PCB.

* * * * *